US007698232B2

(12) United States Patent
Jacobson et al.

(10) Patent No.: US 7,698,232 B2
(45) Date of Patent: Apr. 13, 2010

(54) METHOD AND SYSTEM FOR CONTROLLING PROCESSING PERFORMED BY A MAILING MACHINE

(75) Inventors: Gary S. Jacobson, Norwalk, CT (US); Wesley A. Kirschner, Hamden, CT (US); Joseph M. Mozdzer, Shelton, CT (US); Konstantin G. Kodonas, Norwalk, CT (US); Joseph P. Tokarski, Prospect, CT (US)

(73) Assignee: Pitney Bowes Inc., Stamford, CT (US)

( * ) Notice: Subject to any disclaimer, the term of this patent is extended or adjusted under 35 U.S.C. 154(b) by 1422 days.

(21) Appl. No.: 10/870,736

(22) Filed: Jun. 17, 2004

(65) Prior Publication Data

US 2005/0283449 A1 Dec. 22, 2005

(51) Int. Cl.
*G07B 17/02* (2006.01)

(52) U.S. Cl. ..... 705/401

(58) Field of Classification Search ..... 705/401
See application file for complete search history.

(56) References Cited

U.S. PATENT DOCUMENTS

| | | | | |
|---|---|---|---|---|
| 5,001,648 A | | 3/1991 | Baker | |
| 5,181,245 A | * | 1/1993 | Jones | 705/61 |
| 5,406,317 A | * | 4/1995 | Shimamura et al. | 347/23 |
| 5,724,245 A | * | 3/1998 | Maher et al. | 705/408 |
| 5,806,994 A | | 9/1998 | Coffy et al. | |
| 5,818,020 A | * | 10/1998 | Kabacaoglu et al. | 235/379 |
| 6,024,434 A | | 2/2000 | Shimamura et al. | |
| 6,176,564 B1 | | 1/2001 | Katayama | |
| 6,317,823 B1 | * | 11/2001 | Wakai et al. | 712/220 |
| 6,338,540 B1 | * | 1/2002 | Hasegawa et al. | 347/23 |
| 6,938,980 B2 | * | 9/2005 | Yakura et al. | 347/29 |
| 2002/0073039 A1 | * | 6/2002 | Ogg et al. | 705/60 |

FOREIGN PATENT DOCUMENTS

EP 0461833 A2 6/1991

OTHER PUBLICATIONS

Smith, Patricia J., "Encad Stirs Up Large-Format Market Again (Encad Croma24 and Encad PROe Large Format Printers) (Includes Related Article on HP's New DesignJet Printers) (Product Announcement)," Seybold Report on Publishing Systems, vol. 26, No. 12, Mar. 10, 1997, p. 3(6).*

* cited by examiner

*Primary Examiner*—John W Hayes
*Assistant Examiner*—Nathan Erb
(74) *Attorney, Agent, or Firm*—Brian A. Lemm; Angelo N. Chaclas

(57) ABSTRACT

A mailing machine is provided that determines if entry into a disabled state is coupled with the need for auxiliary information to be entered by the user. If auxiliary information is required to be entered by the user, the print head will not move to the capped position but instead remains in the printing position, and a timer is activated to provide the user with time to enter the information. If the user enters the required information before a predetermined amount of time has expired, the mail piece will be processed without any delay required for the print head to move from the capped position to the printing position. Only if the user has not entered the required information within the predetermined amount of time will the print head move to the capped position.

18 Claims, 4 Drawing Sheets

METHOD AND SYSTEM FOR CONTROLLING PROCESSING PERFORMED BY A MAILING MACHINE

FIELD OF THE INVENTION

The invention disclosed herein relates generally to mail processing systems, and more particularly to methods and systems to control the processing performed by a mailing machine to increase throughput.

BACKGROUND OF THE INVENTION

Mail processing equipment, such as, for example, a mailing machine, often includes different modules that automate the process of producing mail pieces. The typical mailing machine includes a variety of different modules or sub-systems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, and a metering/printing module, i.e., applying evidence of postage to the mail piece. The exact configuration of the mailing machine is, of course, particular to the needs of the user.

One of the factors that determines the cost for shipping a mail piece to a destination is the weight of the mail piece. A mail piece could be, for example, an envelope, postcard, magazine, package, etc. The mailing machine will be provided with the weight of the mail piece, typically from an integral scale incorporated within the mail flow path, an external scale coupled to the mailing machine, or user input. Based on the weight of the mail piece, the postage rate and operator specified service option for a selected carrier, the mailing machine will determine the cost to deliver the mail piece to the destination. The mailing machine will then conduct an accounting procedure for the cost of shipping the mail piece and print an indicium evidencing payment of the postage. Mailing machines have traditionally been capable of printing postage indicia either directly on mail pieces, or on pieces of tape or a label, which are then attached to mail pieces.

For mailing systems that utilize an external platform scale, i.e., a scale that is independent and separate from the mail flow path, there are different methods that can be utilized for determining the weight of an item. In one method, referred to as single piece mode, the user places each mail piece onto the platform of the external scale, and the weight of the mail piece is provided by the scale to a control unit of the mailing machine. The control unit will calculate the cost for shipping the mail piece based on the weight of the mail piece provided by the scale. The user removes the mail piece from the scale and places it on the feed deck of the mailing machine base. Sensors detect the presence of the mail piece on the feed deck and the mail piece is automatically fed into the mailing machine for processing, or, alternatively, the user must press a start button for the mailing machine to transport the mail piece into the mail flow path. The user then repeats this procedure for each mail piece that the user desires to process.

Another method for determining the weight of a mail piece is referred to as a differential weighing method as disclosed in U.S. Pat. No. 5,001,648, which is hereby incorporated by reference. In accordance with the differential weighing method, a plurality of mail pieces are placed on an external scale coupled to a mailing machine and the collective weight of the mail pieces is registered. When the user removes a mail piece from the scale, the difference between the original collective weight of the mail pieces and the new collective weight of the mail pieces remaining on the scale is determined. The cost for shipping of the mail piece is calculated based on the determined differential weight. The user places the mail piece on the feed deck where it is detected by sensors and the mail piece is preferably automatically fed into the mailing machine for processing. The user then repeats this procedure for each mail piece that the user desires to process.

One metric used by customers for determining satisfaction with a mailing machine is the throughput of the mailing machine, i.e., the number of mail pieces that can be processed per hour or minute. Generally, customers desire to have as high a throughput as possible. There are some situations, however, that can operate to decrease the throughput of the mailing machine. For example, in some situations, before a mail piece can be processed by the mailing machine, auxiliary information is required to be entered by the user. Such a situation frequently exists when the user desires to utilize special services provided by the postal service. Special services are provided by the postal service, for an additional fee, to provide greater accountability and security for a mail piece, or improved handling. Such special services include, for example, delivery confirmation, certified mail, insured mail, registered mail, and signature confirmation. Such auxiliary information could include, for example, the destination zip code and/or an identification number that uniquely identifies the mail piece. The mailing machine cannot process the mail piece until the necessary information has been entered. Typically, the mailing machine will enter a disabled state, i.e., will not perform any processing, until the required information has been entered by the user. Thus, a mail piece will not be fed into the mailing machine until the necessary information has been provided.

Entry into a disabled mode, however, will also disable the printing mechanism, and the print head will move from a printing position to a capped position. When the required information has been entered, the print head will return to the print position from the capped position. The print head, however, can take up to 1500 msec or more to move from the capped position to the print position, and thus the processing of the mail piece is delayed until the print head has returned to the printing position. While this delay may seem small with respect to each envelope, it can add significantly to the processing time required when processing hundreds or thousands of mail pieces in a batch. Thus, the delay associated with the movement of the print head from the capped position to the printing position can significantly reduce the throughput of the mailing machine, especially when the mailing machine is being operated in a differential weighing mode and the user is attempting to process the mail pieces as quickly as possible.

Thus, there exists a need for a mailing machine capable of processing mail pieces as described above without decreasing the throughput of the mailing machine.

SUMMARY OF THE INVENTION

The present invention alleviates the problems associated with the prior art and provides a mailing machine capable of processing mail pieces, where auxiliary information is required to be entered by the user, without decreasing the throughput of the mailing machine.

In accordance with embodiments of the present invention, when a mailing machine enters a disabled state, the control unit determines if auxiliary information is being requested to be entered by the user. If information is being requested to be entered by the user, the print head will not move to the capped position but instead remain in the printing position, and a timer is activated to provide the user with time to enter the information. If the user enters the required information before a predetermined amount of time has expired, the print head will not be moved into the capped position, and the mail piece will be processed without any delay required for the print head to move from the capped position to the printing position. Only if the user has not entered the required information within the predetermined amount of time will the print head move to the capped position. Thus, if the user promptly enters the necessary auxiliary information for each mail piece, there will be no delay associated with the print head having to move from the capped position to the printing position, thereby allowing the user to increase the throughput of the mailing machine.

In accordance with other embodiments of the present invention, if the mailing machine detects that auxiliary information is required to be entered by the user, the mailing machine will not enter a disabled state, but instead remain in a current operating state, and therefore the print head will remain in the printing position, until the user has provided the required information. Once the user has entered the required information, the control unit will respond to the detection of the mail piece on the feed deck and process the mail piece. Thus, the mailing machine will not enter into a disabled state when auxiliary information is being requested from the user, and there will be no corresponding delay associated with the print head having to move from the capped position to the printing position, thereby increasing the throughput of the mailing machine.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
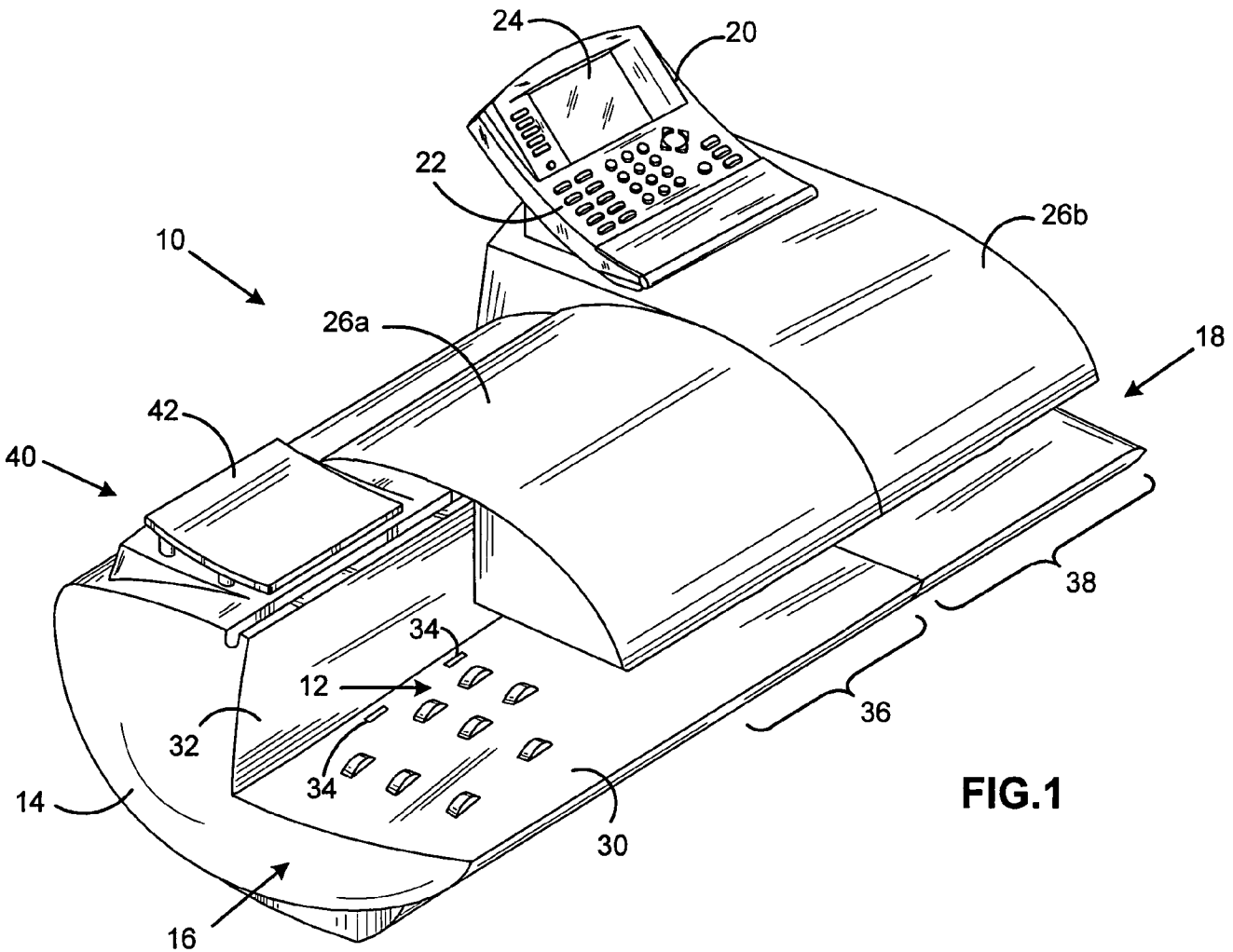
FIG. 1 illustrates a mailing machine capable of performing processing according to embodiments of the present invention.

In describing the present invention, reference is made to the drawings, wherein there is seen in FIG. 1 a mailing machine 10 that is capable of processing mail pieces without decreasing the throughput of the mailing machine according to embodiments of the present invention. Mailing machine 10 comprises a base unit, designated generally by the reference numeral 14, the base unit 14 having a mail piece input end, designated generally by the reference numeral 16, and a mail piece output end, designated generally by the reference numeral 18. A control unit 20 is mounted on the base unit 14, and includes one or more input/output devices, such as, for example, a keyboard 22 and a display device 24. Control unit 20 preferably includes one or more controller units, such as, for example, a microprocessor, general or special purpose processor or the like, to control operation of the mailing machine 10. One or more cover members 26*a*, 26*b* are pivotally mounted on the base 14 so as to move from the closed position shown in FIG. 1 to an open position (not shown) to expose various operating components and parts for service and/or repair as needed.

The base unit 14 further includes a horizontal feed deck 30 which extends substantially from the input end 16 to the output end 18. A plurality of nudger rollers 12 are preferably mounted under the feed deck 30 and project upwardly through openings in the feed deck so that the periphery of the rollers 12 is slightly above the upper surface of the feed deck 30 and can exert a forward feeding force on a succession of mail pieces placed in the input end 16. One or more sensors 34, such as, for example, optical sensors, are located in the feed deck 30 to detect the presence of a mail piece on the feed deck 30. A registration wall 32 defines a mail piece registration surface substantially perpendicular to the feed deck 30 that extends substantially from the input end 16 to the output end 18. A scale 40, including a platter 42 (which may be removable), is preferably located near the input end 16, such as, for example, above and adjacent to the registration wall 32 as illustrated. Components of the weighing scale 40 other than the platter 42, including a load cell and related electronics, can be located within the base unit 14. Thus, while the scale 40 may be integral with the base unit 14, it is still considered an external platform scale as it is independent and separate from the mail flow path along the feed deck 30. Alternatively, a separate external stand alone scale (not shown) may be coupled to the mailing machine 10 by any suitable communication link, such as, for example, a USB or RS232 interface.

The scale 40 can be operated by a user to weigh mail pieces utilizing either the single piece mode or differential weighing mode previously described. When the mail pieces are removed from the platter 42 of the scale 40, the user places the mail piece in the input end 16 where one or more of the sensors 34 detect the mail piece. Signals from the sensors 34 are sent to the control unit 20, which in response, will activate the nudger rollers 12 to feed the mail piece along the feed deck 30, with the top edge of the mail piece being registered against the registration wall 32. Alternatively, control unit 20 may require an input from the user, such as, for example, pressing a start button, in lieu of or in addition to the signal from sensors 34, before activating the nudger rollers 12. The mail pieces may be passed through one or more modules, such as, for example, a singulator module and a moistening/sealing module, as are well known. Each of these modules is located generally in the area indicated by reference numeral 36. The mail pieces are then passed to a metering/printing module located generally in the area indicated by reference numeral 38, where an indicium evidencing postage will be printed on the mail piece. Alternatively, if a mail piece is not fed through the mailing machine 10, the indicium may be printed on a tape or label that can be affixed to the mail piece.

Figure 2:
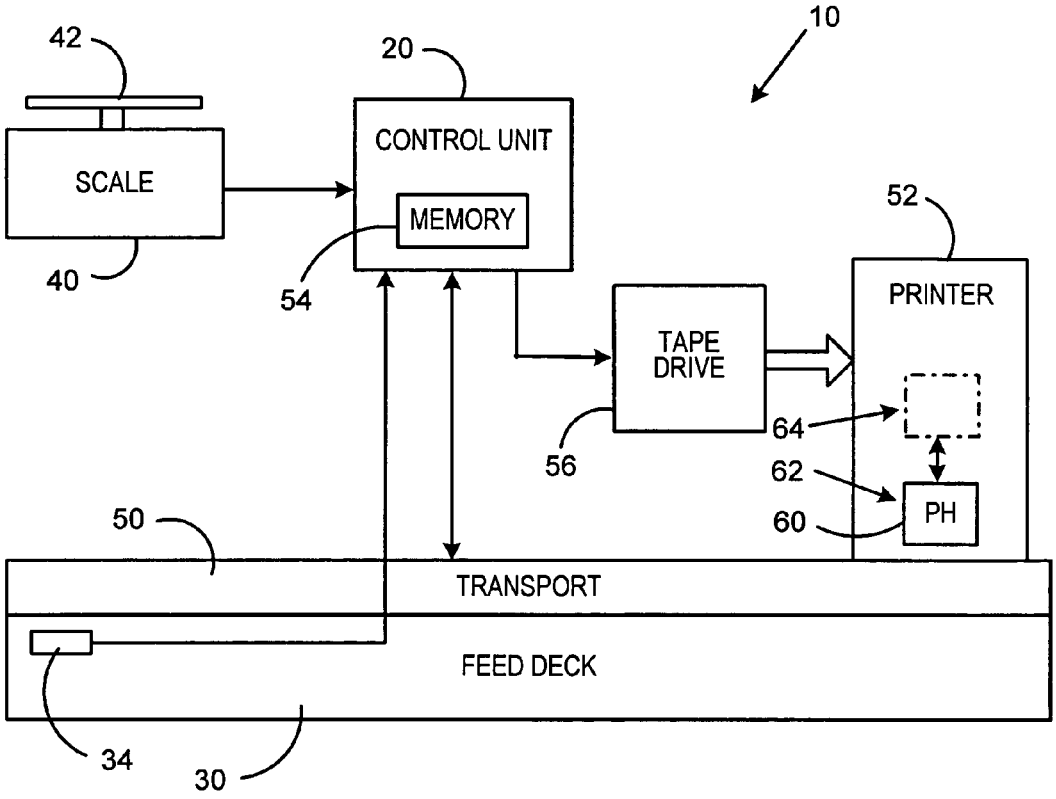
FIG. 2 illustrates in block diagram form portions of the mailing machine of FIG. 1.

FIG. 2 illustrates in block diagram form portions of the mailing machine 10 illustrated in FIG. 1. As illustrated in FIG. 2, a transport 50, including, for example, the nudger rollers 12 of FIG. 1, utilized to transport mail pieces along the feed deck 30 is coupled to the control unit 20 and transports mail pieces based on signals provided from the control unit 20. The transport 50 will transport the mail pieces through the modules of the mailing machine 10, including a printer 52, wherein a print head (PH) 60 is utilized to print on each mail piece. Printer 52 is also adapted to print on a tape from the tape drive 56. The printer 52 moves the print head 60 between two positions, a printing position 62 and a capped position 64, based on the operating status of the mailing machine 10. Only when the print head 60 is in the printing position 62 is printing possible. If the print head 60 is in the capped position 64, the print head 60 cannot print. Thus, when printer 52 is not being requested to print, the print head 60 will be moved into the capped position 64, thereby protecting the nozzles of the print head from damage as well as preventing them from becoming clogged by ink drying within the nozzle. It should be noted that the print head 60 may also be moved into other positions, such as a maintenance position, during which maintenance operations can occur.

The scale 40 is coupled to the control unit 20. Scale 40 can provide the weight of an object on the scale 40 to control unit 20, or could provide a representative signal to control unit 20 from which the control unit 20 will determine the weight of the object. The control unit 20 will determine the necessary postage costs for a mail piece, based at least in part on the weight of the mail piece as received from the scale 40, utilizing one or more rating tables that can be stored in a memory 54. Alternatively, if rating tables are stored within the scale 40, the scale 40 could provide the postage costs for a mail piece to the control unit 20. Control unit 20 will generate an indicium, based on the determined postage cost, for printing on the mail piece by print head 60 as the mail piece is transported past the printer 52. Alternatively, control unit 20 can activate the tape drive 56 to deliver a tape to the printer 52, and the print head 60 will print the indicium on the tape for adhering to a mail piece.

As previously noted, when the mailing machine 10 is being operated in a differential weighing mode, a plurality of mail pieces are placed on the platter 42 of scale 40 and the collective weight of the mail pieces is registered. When the user removes a mail piece from the platter 42, the difference between the original collective weight of the mail pieces and the new collective weight of the mail pieces remaining on the platter 42 of the scale 40 is determined. The cost for shipping of the mail piece is calculated based on the determined differential weight. Since each mail piece must be removed from a stack of mail pieces previously placed on the platter 42 and placed on the feed deck 30, efficient operation of the mailing machine 10 is dependent upon the user and the speed at which the mailing machine 10 can process each mail piece. As the user will typically attempt to operate the mailing machine 10 as quickly as possible to achieve the greatest throughput, it is important that any delays associated with the processing being performed by the mailing machine 10 be minimized.

Figure 3:
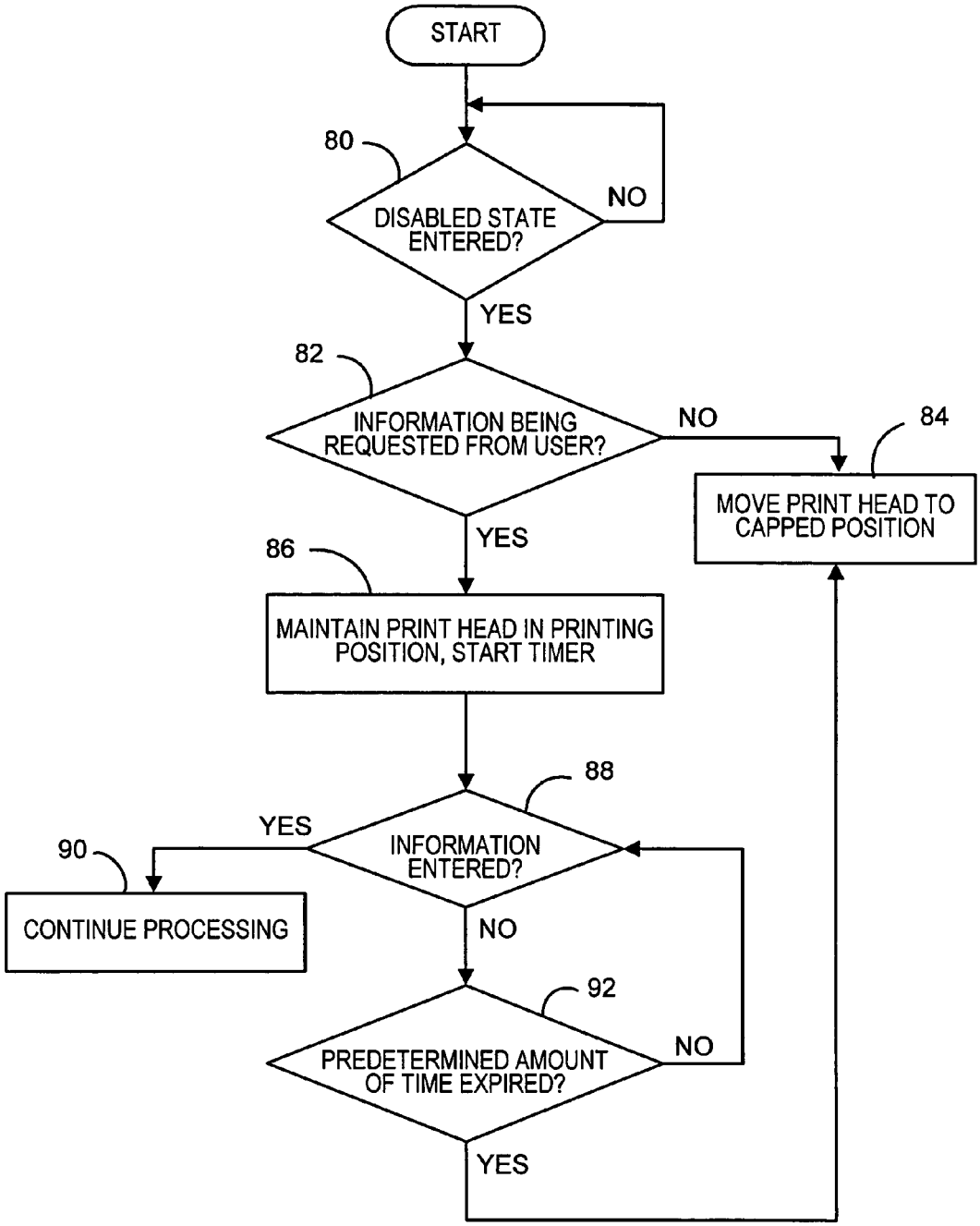
FIG. 3 illustrates in flow diagram form the processing performed by mailing machine 10 according to an embodiment of the present invention.

The processing performed by mailing machine 10 according to one embodiment of the present invention is illustrated in flow diagram form in FIG. 3. In step 80, control unit 20 determines if the mailing machine 10 (and therefore the printer 52), or just printer 52, has entered a disabled state. Entry into a disabled state could be based, for example, on the mailing machine 10 having completed processing of a mail piece and no subsequent mail piece being detected on the feed deck 30, a command input by the user, or the need for a user input before processing can continue. The processing will continue to loop until the control unit 20 determines that the printer 52 has entered a disabled state. When it has been determined that the printer 52 has entered a disabled state, then in step 82 control unit 20 will determine if the disabled state was entered due to information being requested from the user. Such a situation can exist when the user desires to send a mail piece utilizing one or more special services offered by the postal authority. As previously noted, some special services require additional information for each mail piece, such as, for example, the destination zip code or unique identification number. It should be understood that the present invention is not limited to only situations when information for special services is being requested, but can also be utilized for other system events in which the printer 52 may enter a disabled state while awaiting an input from the user. Such other system events could include, for example, zip/zone/country entry when not using special services, or user acknowledgement of warning or error conditions (e.g., low ink, low postage funds, inspection due soon, etc.). Determination of the reason for entry into a disabled state could be done, for example, based on the display screen being presented to the user on the display 24. Thus, screens where the user is being asked to enter information could be flagged and any time a flagged screen is being displayed and the printer 52 enters into a disabled state, a yes response will be generated in step 82.

If in step 82 it is determined that information is not being requested from the user, then in step 84 the printer 52 will move the print head 60 into the capped position 64. If in step 82 it is determined that information is being requested from the user, then in step 86 the control unit 20 will instruct the printer 52 to maintain the print head 60 in the printing position 62 and a timer will be started. Thus, the print head 60 will not automatically be moved to the capped position 64 when the mailing machine 10 (or printer 52) enters a disabled state as is done in conventional mailing machines, but instead will be maintained in the printing position 62 if information is being requested from the user. The timer could be implemented, for example, by software running on the control unit 20, hardware within the control unit 20, or a combination of the two. The timer will provide an indication of expiration of a predetermined time period to the control unit 20. Such a predetermined time period could be, for example, 20 secs, although it should be understood that any time period could be utilized.

In step 88, it is determined if the information being requested from the user has been entered. If the user has entered the necessary information (or acknowledgement), then in step 90 the mailing machine 10 will continue processing the mail pieces, including, for example, generating and printing an indicium on a mail piece. The processing in step 90 occurs with minimal delay, as the print head 60 is already in the printing position 62 and thus there is no delay while the print head 60 moves from the capped position 64 to the printing position 62 as with conventional mailing machines. By removing the delay previously necessary for conventional mailing machines, mailing machine 10 according to this embodiment has an increased throughput. If in step 88 it is determined that the information being requested from the user has not been entered, then in step 92 it is determined if the predetermined time period, as set by the timer in step 86, has expired. If the predetermined time period has not expired, the processing will loop back to step 88. Once it is determined in step 92 that the predetermined time period has expired and the information being requested has not been entered by the user, then the processing will move to step 84 where the printer 52 will move the print head 60 to the capped position 64.

Thus, suppose for example that the user is processing a batch of mail pieces with mailing machine 10 utilizing differential weighing and applying a special service to the mail pieces that requires the user to enter auxiliary information for each mail piece. As each mail piece is removed from the platter 42 of scale 40, the control unit 20, performing the processing as described above with respect to FIG. 3, will cause the printer 52 to enter a disabled state to wait for the information to be entered by the user; however, the print head 60 will not immediately be moved to the capped position 64. If the user enters the required information before the predetermined time period expires, and places the mail piece on the feed deck 30, there is no time delay required while the print head 60 moves from the capped position 64 back into the printing position 62, and therefore no corresponding decrease in the throughput of the mailing machine 10.

Figure 4:
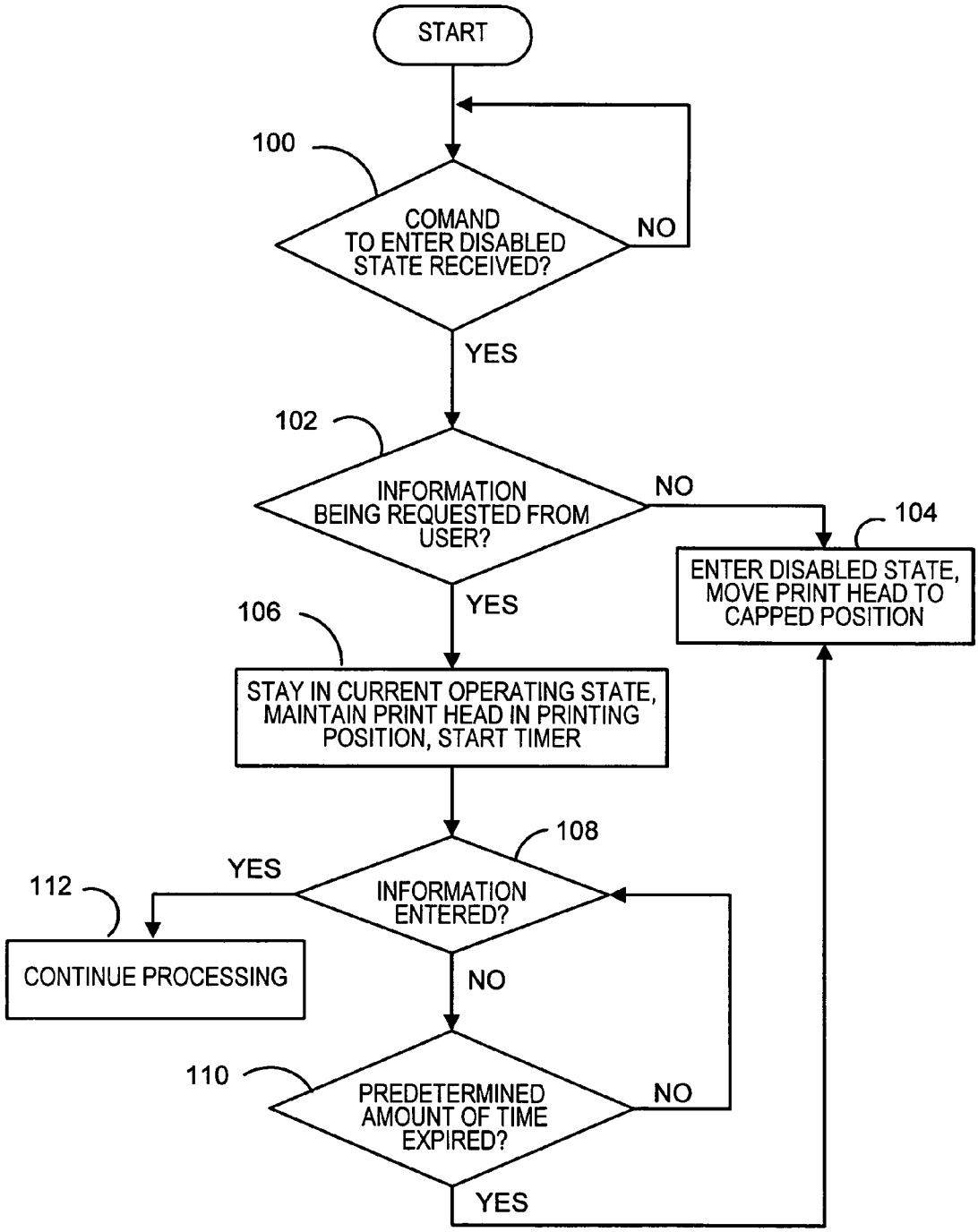
FIG. 4 illustrates in flow diagram form the processing performed by mailing machine 10 according to another embodiment of the present invention.

The processing performed by mailing machine 10 according to another embodiment of the present invention is illustrated in flow diagram form in FIG. 4. In step 100, it is determined if a command for the mailing machine 10 (and therefore the printer 52), or just the printer 52, to enter a disabled state has been received. Processing will continue to loop through step 100 until a command to enter a disabled state has been received. Then in step 102, control unit 20 will determine if information is being requested from the user. If information is not being requested from the user, then in step 104 the disable request will be honored, i.e., executed, and the mailing machine 10 (or just printer 52) will enter the disabled state and move the print head 60 into the capped position 64. If in step 102 it is determined that information is being requested from the user, then in step 106 the disable command will not be honored, i.e., the command will not be executed, and the mailing machine 10 (or just printer 52) will remain in the current operating state, no commands to process the mail piece will be issued, and a timer started. Therefore, the print head 60 will remain in the printing position 62. Thus, for example, if the mailing machine is being operated in the differential weighing mode, and the user is required to enter auxiliary information for a mail piece just removed from the platform 42, the control unit 20 will maintain the operating status of the mailing machine 10 in the differential weighing mode and avoid issuing a command to process the mail piece even if the sensors 34 detect the mail piece on the feed deck 30.

In step 108 it is determined if the user has entered the required information. The processing will continue to loop until a predetermined time period (similarly as described above) has expired in step 110, in which case the command to enter the disabled state will be honored in step 104. Once the required information has been entered, then in step 112 the mailing machine 10 will continue processing the mail piece, including issuing a command to start processing the mail piece if the mail piece is detected on the feed deck 30 by the sensors 34. It should be noted that the timer may be optional, and instead the processing can continue to loop through step 108 until the information has been entered by the user. The processing in step 112 occurs with minimal delay, as the print head 60 is already in the printing position 62 and thus there is no delay while the print head 60 moves from the capped position 64 to the printing position 62 as with conventional mailing machines. By removing the delay previously necessary for conventional mailing machines, mailing machine 10 according to this embodiment has an increased throughput. Thus, according to this embodiment, the mailing machine 10 will not enter a disabled state under certain conditions, there is no time delay required while the print head 60 moves from the capped position 64 back into the printing position 62, and therefore there is no corresponding decrease in the throughput of the mailing machine 10.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. In a mailing machine including a printer having a print head for printing on mail pieces, a method for the mailing machine to operate comprising:

determining that the printer has entered a disabled state;

determining whether the mailing machine is requesting an operator to input information;

when the mailing machine is not requesting the operator to input information, moving the print head into a capped position; and when the mailing machine is requesting the operator to input information: maintaining the print head in a printing position;

when the information being requested, by the mailing machine, to be input by the operator has been input before a predetermined amount of time has expired, continuing processing with the print head in the printing position; and when the information being requested, by the mailing machine, to be input by the operator has not been input before the predetermined amount of time has expired, moving the print head to the capped position.

2. The method of claim 1, wherein the information being requested, by the mailing machine, to be input by the operator includes a destination zip code for a mail piece.

3. The method of claim 1, wherein the information being requested, by the mailing machine, to be input by the operator includes an identification number for a mail piece.

4. The method of claim 1, wherein the information being requested, by the mailing machine, to be input by the operator includes an acknowledgement of an error condition.

5. The method of claim 1, wherein determining whether the mailing machine is requesting the operator to input information comprises:

determining whether the mailing machine is requesting the operator to input information based on a screen being presented to the operator on a display of the mailing machine.

6. The method of claim 1, wherein continuing processing with the print head in the printing position comprises:

generating an indicium for a mail piece; and printing the indicium on the mail piece with the print head.

7. In a mailing machine including a printer having a print head for printing on mail pieces, a method for the mailing machine to operate comprising:

determining that a command for the printer to move the print head into a capped position has been received;

determining whether the mailing machine is requesting an operator to input information;

when the mailing machine is not requesting the operator to input information, executing the command to move the print head into the capped position; and when the mailing machine is requesting the operator to input information:

maintaining the print head in a printing position and starting a timer to provide a predetermined amount of time;

when the predetermined amount of time expires before the information being requested, by the mailing machine, to be input by the operator has been input, executing the command to move the print head into the capped position; and when the information being requested, by the mailing machine, to be input by the operator has been input before the predetermined amount of time expires, continuing operation with the print head in the printing position.

8. The method of claim 7, wherein the information being requested, by the mailing machine, to be input by the operator includes a destination zip code for a mail piece.

9. The method of claim 7, wherein the information being requested, by the mailing machine, to be input by the operator includes an identification number for a mail piece.

10. The method of claim 7, wherein the information being requested, by the mailing machine, to be input by the operator includes an acknowledgement of an error condition.

11. The method of claim 7, wherein determining whether the mailing machine is requesting the operator to input information comprises:

determining whether the mailing machine is requesting the operator to input information based on a screen being presented to the operator on a display of the mailing machine.

12. A mailing machine comprising:

a printer having a print head, the print head being movable between a printing position where printing can occur and a capped position where printing cannot occur;

means for determining that the printer has entered a disabled state; and means for determining whether the mailing machine is requesting an operator to input information;

wherein:

when the mailing machine is not requesting the operator to input information, the printer will move the print head into the capped position; and when the mailing machine is requesting the operator to input information:

the printer will maintain the print head in the printing position;

when the information being requested, by the mailing machine, to be input by the operator has not been input before a predetermined amount of time has expired, the printer will move the print head to the capped position; and when the information being requested, by the mailing machine, to be input by the operator has been input before the predetermined amount of time has expired, the mailing machine will continue processing with the print head staying in the printing position.

13. The mailing machine of claim 12, wherein the mailing machine further comprises a display on which screens are presented to the operator, and the means for determining whether the mailing machine is requesting an operator to input information comprises:

means for determining whether the mailing machine is requesting an operator to input information based on a screen being presented to the operator on the display.

14. The mailing machine of claim 12, wherein the information being requested, by the mailing machine, to be input by the operator includes a destination zip code for a mail piece.

15. The mailing machine of claim 12, wherein the information being requested, by the mailing machine, to be input by the operator includes an identification number for a mail piece.

16. The mailing machine of claim 12, wherein the information being requested, by the mailing machine, to be input by the operator includes an acknowledgement of an error condition.

17. A mailing machine comprising:

a printer having a print head, the print head being movable between a printing position where printing can occur and a capped position where printing cannot occur;

means for determining that the printer has received a command to move the print head into the capped position;

means for determining whether the mailing machine is requesting an operator to input information; and a timer, the timer being activated after it has been determined that information is being requested, by the mailing machine, to be input by the operator, to provide a predetermined amount of time;

wherein:

when the mailing machine is not requesting the operator to input information, the command to move the print head into the capped position is executed; and when the mailing machine is requesting the operator to input information:

the print head is maintained in the printing position;

when the information being requested, by the mailing machine, to be input by the operator has not been input before the predetermined amount of time has expired, the command to move the print head into the capped position is executed; and when the information being requested, by the mailing machine, to be input by the operator has been input before the predetermined amount of time has expired, the mailing machine continues processing with the print head staying in the printing position.

18. The mailing machine of claim 17, wherein the mailing machine further comprises a display on which screens are presented to the operator, and the means for determining whether the mailing machine is requesting the operator to input information comprises:

means for determining whether the mailing machine is requesting the operator to input information based on a screen being presented to the operator on the display.

* * * * *